United States Patent [19]

Cass

[11] 4,199,867

[45] Apr. 29, 1980

[54] HARMONOGRAPH

[76] Inventor: George Cass, Gelber St. 22, Ramat Danya, Jerusalem, Israel

[21] Appl. No.: 11,047

[22] Filed: Feb. 9, 1979

[30] Foreign Application Priority Data

Feb. 23, 1978 [IL] Israel ..... 54114

[51] Int. Cl.[2] ..... B43L 11/00

[52] U.S. Cl. ..... 33/27 L

[58] Field of Search ..... 33/27 L

[56] References Cited

U.S. PATENT DOCUMENTS

| | | | |
|---|---|---|---|
| 3,384,966 | 5/1968 | Lias | 33/27 L |
| 3,496,641 | 2/1970 | Mills | 33/27 L |
| 3,521,360 | 7/1970 | Wulf | 33/27 L |
| 3,590,488 | 7/1971 | Padowicz | 33/27 L |

*Primary Examiner*—Harry N. Haroian

[57] ABSTRACT

The invention provides a collapsible and compactable harmonograph adapted to generate compound harmonic oscillations and thereby record different, complex, consistent, geometrical patterns of diminishing scope, comprising a drawing surface suspended from a gimbal-mounted member by means of at least three flexible, collapsible suspension cords and at least two flexible, collapsible, cross-bracing diagonal cords, which drawing surface and its suspension constitute a first pendulum adapted to undergo pendulum-like oscillations in an infinite number of vertical planes, but to be substantially restrained from performing rotational or torsional oscillations about its central vertical axis by virtue of said diagonal cross-bracing cords; a second pendulum comprising a bob-like arrangement and a flexible, collapsible suspension cord attached to the bottom side of said drawing surface, and a stylus mountable independently of the drawing surface and adapted to contact the drawing surface at an adjustable contact pressure and to be held in positive contact therewith during the compound harmonic oscillation effected by the interaction of the two linked gravity pendulums.

8 Claims, 20 Drawing Figures

HARMONOGRAPH

Figure 1:
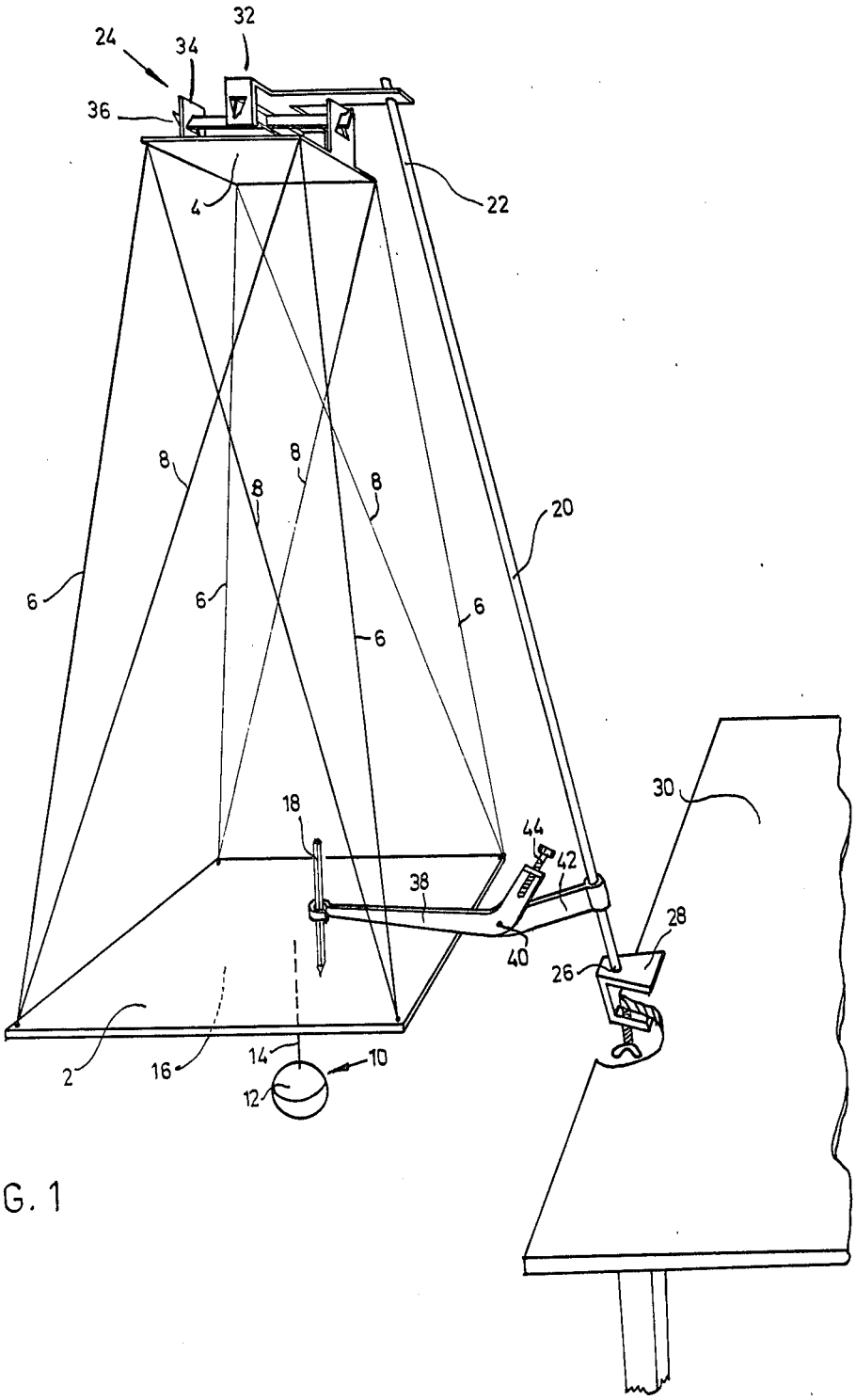
Figure 2:
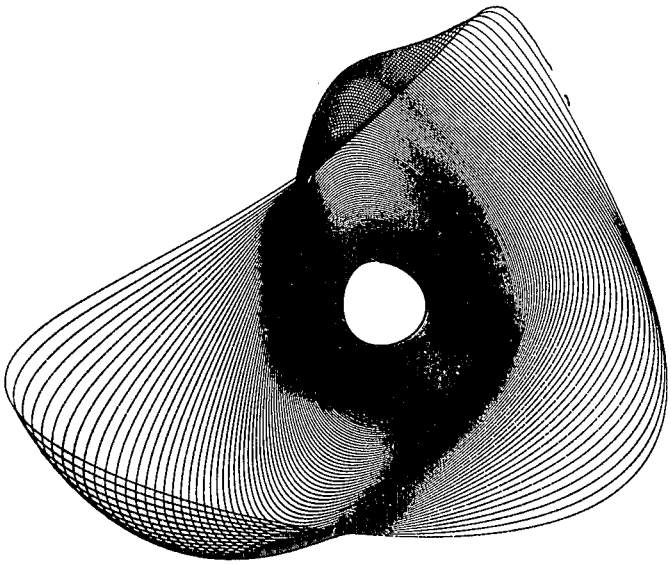
Figure 3:
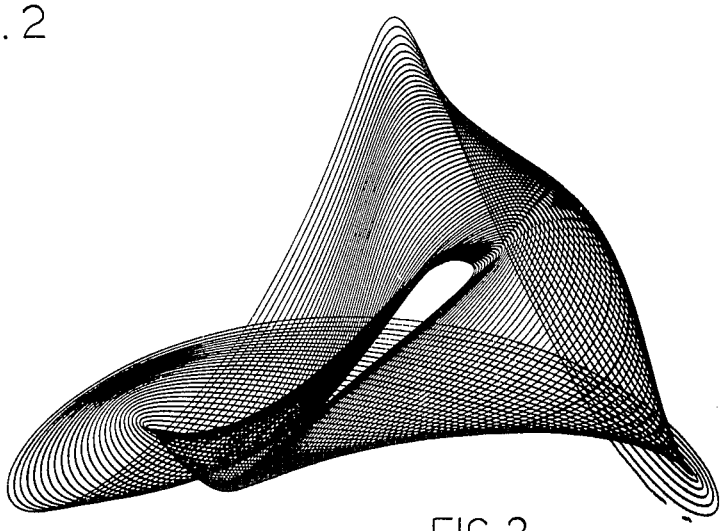
Figure 4:
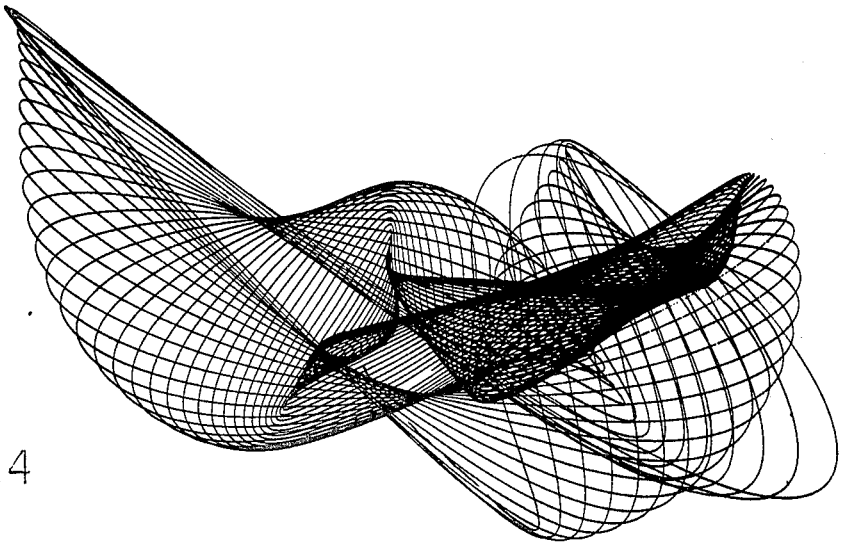
Figure 5:
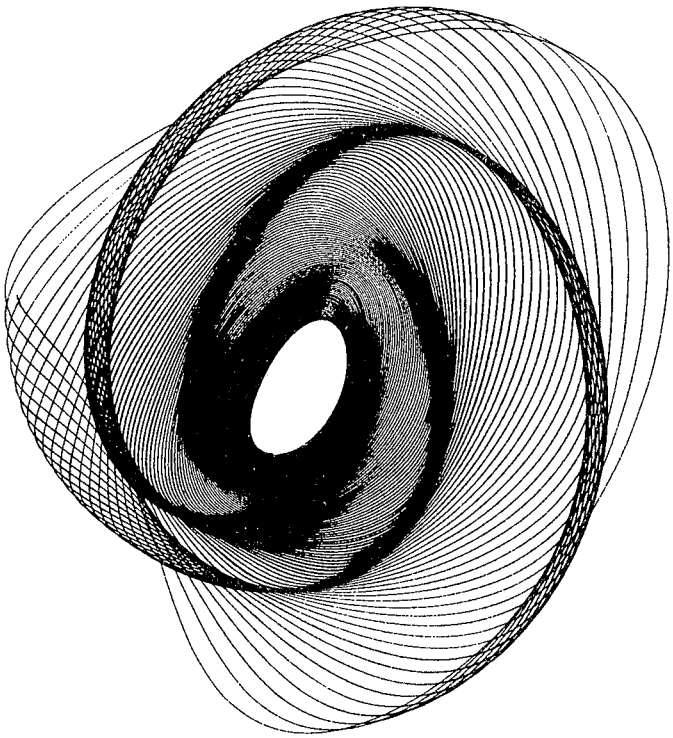
Figure 6:
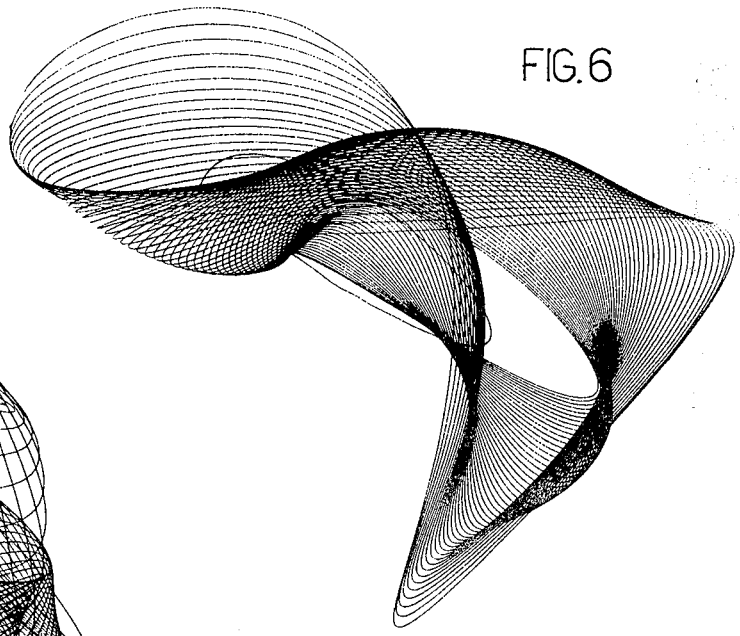
Figure 7:
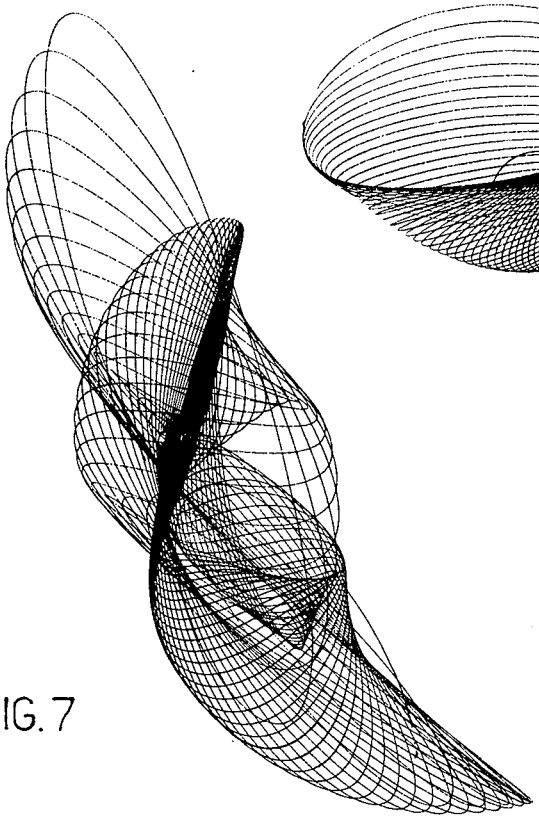
Figure 10:
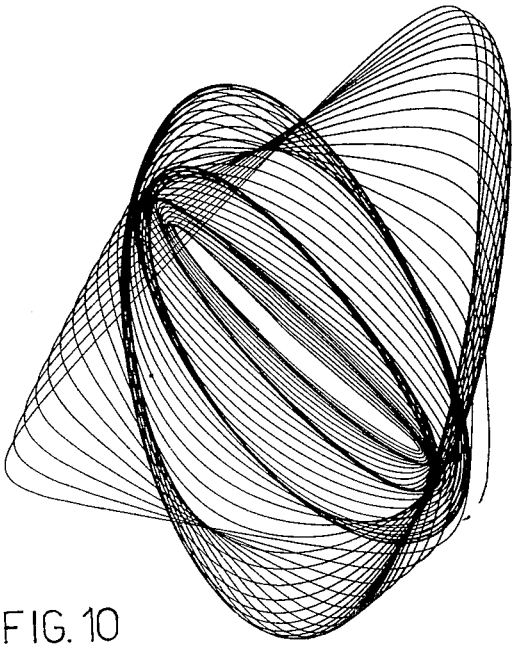
Figure 11:
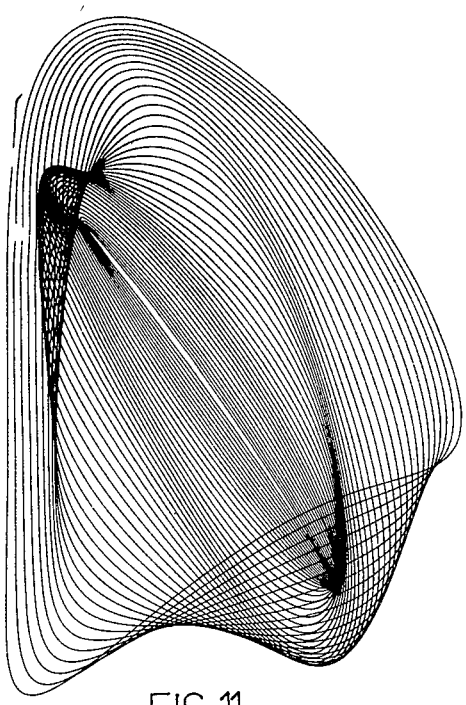
Figure 8:
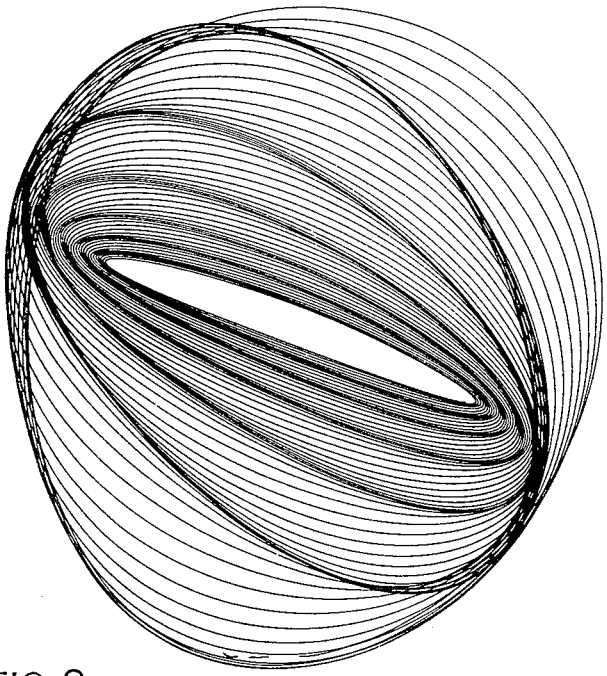
Figure 9:
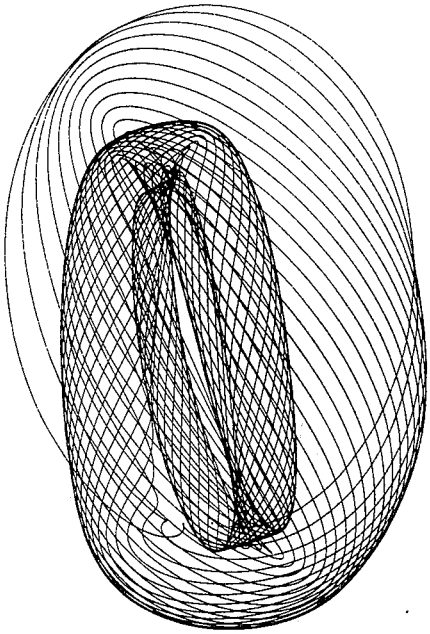
Figure 14:
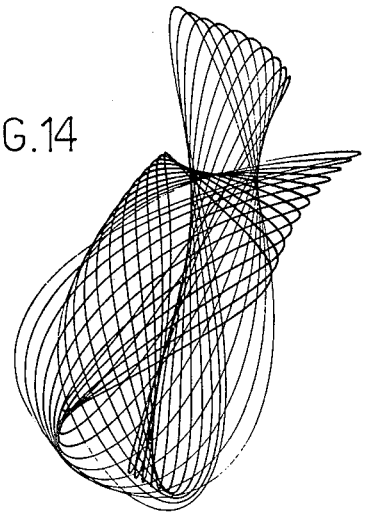
Figure 12:
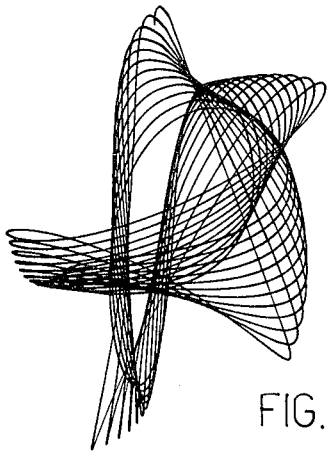
Figure 13:
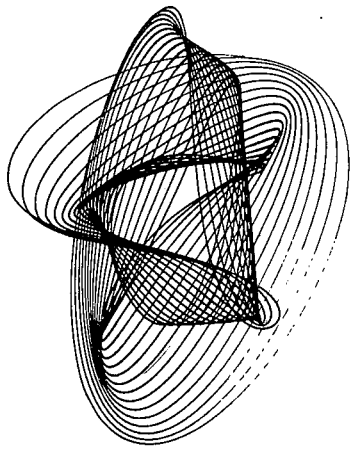
Figure 15:
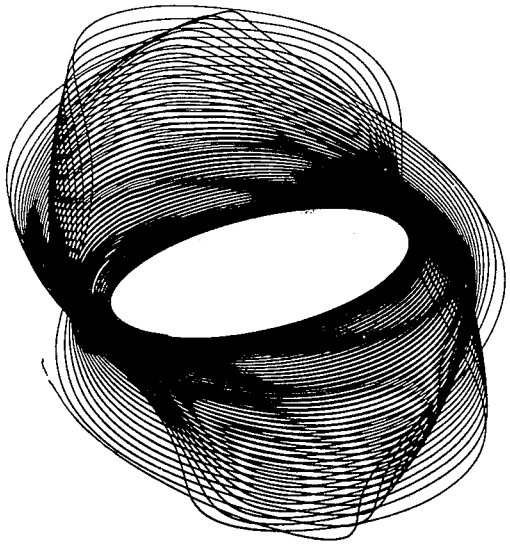
Figure 16:
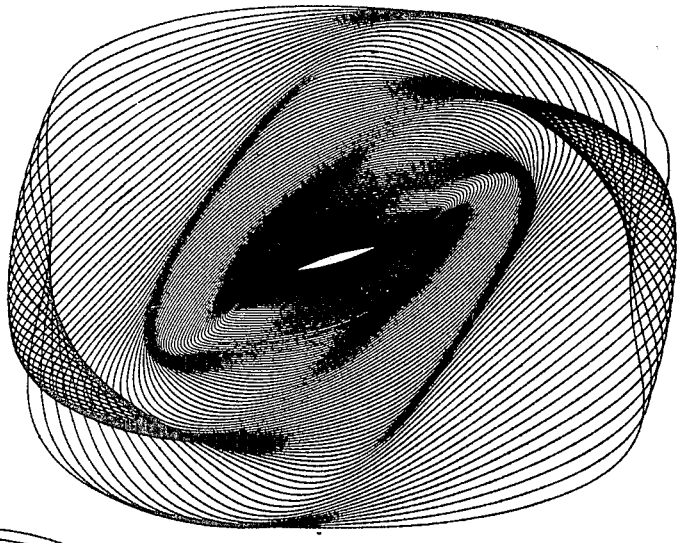
Figure 17:
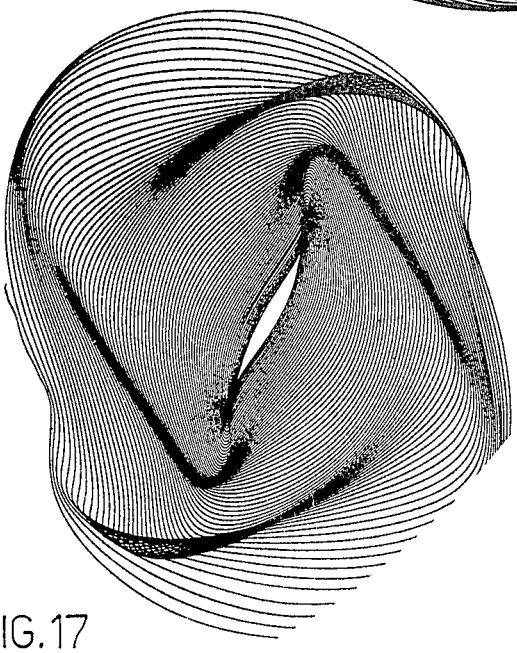
Figure 18:
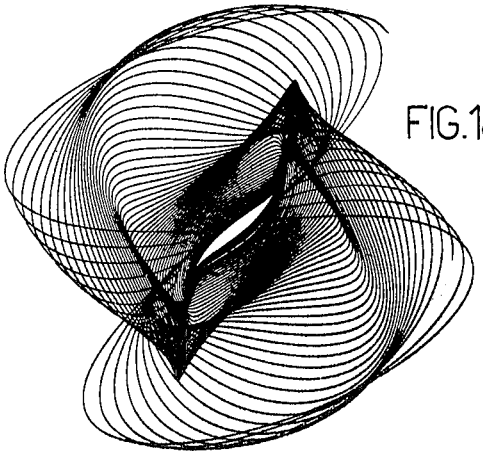
Figure 19:
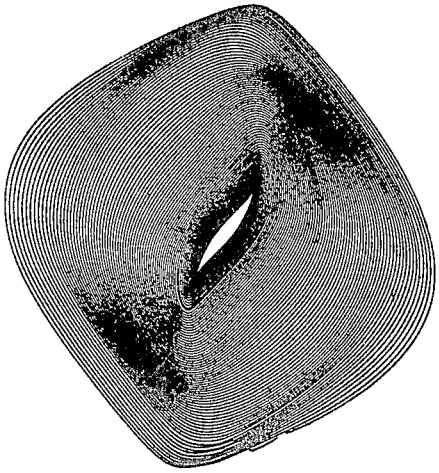
Figure 20:
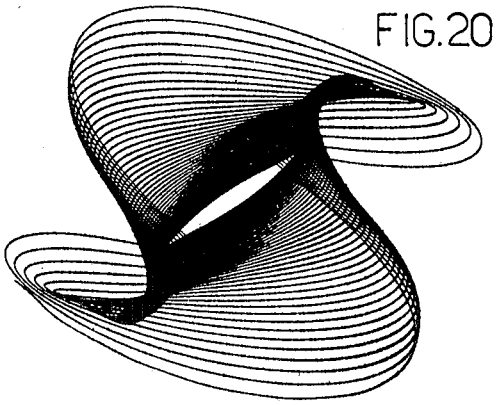

The present invention relates to a collapsible and compactable harmonograph adapted to generate compound harmonic oscillations and thereby record different complex consistent geometrical patterns of diminishing scope.

Various types of harmonographs are known in the art. Israel Pat. No. 30059, for instance, discloses a harmonograph comprising two pendulums, a holder for a recording device mounted on one of said pendulums, and a holder for a record-receiving member mounted on the other of said pendulums in position to enable said recording device to record thereon when the two pendulums are set in oscillation.

Another harmonograph is disclosed by Israel Pat. No. 35892, which teaches a drawing device for obtaining geometric curves comprising a drawing base suspended from a frame for pendulous oscillation and adapted to carry a writing surface and a drawing element mounted on the frame independently of the base and held in positive contact with the writing surface during oscillation of the base.

It will be noted that the two pendulums of the harmonograph according to Israel Pat. No. 30059, while of adjustable frequency, are able to oscillate in one plane only. The harmonograph according to Israel Pat. No. 35 892, on the other hand, is provided with one pendulum-like element only, which acts both as a gravity pendulum and a torsional pendulum.

In contradistinction to these prior-art devices, the present invention proposes a harmonograph comprising:

(a) a drawing surface suspended from a gimbal-mounted member by means of at least three flexible, collapsible suspension cords and at least two flexible, collapsible, cross-bracing diagonal cords, which drawing surface and its suspension constitute a first pendulum adapted to undergo pendulum-like oscillations in an infinite number of vertical planes, but to be substantially restrained from performing rotational or torsional oscillations about its vertical axis by virtue of said diagonal cross-bracing cords;

(b) a second pendulum comprising a bob-like arrangement and a flexible, collapsible suspension cord attached to the bottom side of said drawing surface, and (c) a stylus mountable independently of said drawing surface and adapted to contact said drawing surface at an adjustable contact pressure and to be held in positive contact therewith during the compound harmonic oscillation effected by the interaction of said two linked gravity pendulums.

As will be realized from the description hereinafter, the harmonograph according to the present invention not only differs from these prior-art devices in several essential design features but, by virtue of these features, also represents an improvement over these devices.

Thus, the novel use of a drawing surface suspended from a gimbal-mounted member by means of flexible and collapsible suspension and cross-bracing cords in combination with a second pendulum comprising a bob-like arrangement and a flexible, collapsible suspension cord to provide a lightweight, commercially saleable kit adapted to be readily assembled and dismantled, to generate compound harmonic oscillations and to record different complex geometrical patterns of consistent, diminishing scope constitutes a major advance in the field of harmonographs, which to date has at best supplied drawing devices for mass public use of the type described in Israel Pat. No. 35892.

While the invention will now be described in connection with a certain preferred embodiment with reference to the following illustrative figures so that it may be more fully understood, it is stressed that the particulars shown and described are by way of example and for purposes of illustrative discussion only and are presented in the cause of providing what is believed to be the most useful and readily understood description of the principles and conceptual aspects of the invention. In this regard no attempt is made to show structural details of the harmonograph and its constituent parts in more detail than is necessary for a fundamental understanding of the invention, the description taken with the drawings making apparent to those skilled in the art how the several forms of the invention may be embodied in practice.

In the drawings:

FIG. 1 is an isometric view of a harmonograph according to the invention, and FIGS. 2–20 - are examples of patterns actually generated by the harmonograph according to the invention.

Referring first to FIG. 1, there is illustrated a collapsible and compactable harmonograph according to the present invention, comprising a drawing surface 2 suspended from a gimbal-mounted member 4 by means of at least three flexible, collapsible suspension cords 6 and at least two flexible, collapsible, cross-bracing cords 8, which drawing surface 2 and its suspension 4,6,8 constitute a first pendulum adapted to undergo pendulum-like oscillations in an infinite number of vertical planes, but to be substantially restrained from performing rotational or torsional oscillations about its central, vertical axis by virtue of said diagonal cross-bracing cords 8. The harmonograph further comprises, as shown, a second pendulum 10 comprising a bob-like arrangement 12 and a flexible, collapsible suspension cord 14 attached to the bottom side 16 of said drawing surface 2. The harmonograph is provided with a stylus 18 mountable independently of said drawing surface 2 and adapted to contact said drawing surface at an adjustable contact pressure and to be held in positive contact therewith during the compound harmonic oscillations effected by the interaction of said two linked pendulums.

The harmonograph preferrably further comprises a mounting arm 20, to the upper end 22 of which is rigidly fixed the gimbal device 24, from which said gimbal-mounted member 4 is suspended, and the other end 26 of which is provided with means 28 of attachment to a stationary support 30.

Referring now to said Figure in greater detail, as shown, provision is made for a gimbal device 24 consisting of three elements: an upper, stationary frame 32 rigidly attached to a mounting arm 20, a lower, tiltable frame 34, to which is attached, or with which is integral, a member 4, and a cross member 36 which links the upper and the lower frame. The gimbal device 24, as such known, permits the tiltable frame 34 to tilt freely in every direction, but restrains it from rotating about the axis through the center of, and perpendicular to, the member 4.

Similarly, the combination of suspension cords 6 and, as stated, cross-bracing cords 8 restrain the drawing surface 2 from rotating about its central, vertical axis.

In a preferred embodiment, the gimbal device 24 is of the knife-edge type, i.e., the cross member 36 is provided with knife edges which rest in appropriate bearings arranged in the upper and lower gimbal frame. It is, however, possible to use also other low-friction elements such as rolling-friction bearings and their appropriate shafts, or sliding-friction bushings of any low-friction material such as brass, bronze, teflon, nylon or the like, and their appropriate shafts. A gimbal-like effect permitting tilting in any direction, but preventing rotation could also be obtained by the use of metal bellows of the type utilized for flexible couplings or any other similar flexure device.

The lower end of the arm 20 is provided with means of attachment 28 to a stationary support, for example to a table. Arm 20, in a preferred embodiment is made of a tubular metal profile since it must be strong and rigid enough to support the weight of the entire apparatus, but can also be made of other materials, such as glass-fiber reinforced plastics or the like. For better storability as well as for ease of packaging of the harmonograph kit, it is advantageous to use a telescoping or otherwise collapsible arm. Given the substantially tapering outline of the drawing surface 2 and its main suspensions 6, it is obviously desirable, for reasons of economy and strength, to have the arm 20 slant at such an angle as will bring its upper end as close as possible to the upper gimbal frame 32, while leaving enough clearance between its lower end and the near edge of the drawing surface 2 to enable the latter to swing with an amplitude large enough to bring its far edge below the stylus 18.

The drawing surface 2 which in a preferred embodiment is of a rectangular shape (23×31 cm), but which can indeed be of any reasonable shape and size, is suspended from the member 4 by at least three and preferably four main suspension cords 6 as shown and at least two, and preferably two pairs of cross-bracing, diagonal cords 8, and, in turn, serves as a point of suspension for the bob-like arrangement 12 of the second pendulum 10 which is centrally attached to the bottom 16 of the drawing surface 2 by a cord 14.

The drawing surface 2 can consist of any material provided it has a plane, smooth surface and a certain minimum mass required to keep the suspension cords 6 and 8 taut and to ensure oscillations over a period of time of reasonable length. The greater the mass, the more energy is stored upon the drawing surface 2 being set oscillating and the smaller the loss of amplitude between complete swings. A certain optimum mass must of course be aimed at, not only because of considerations of mechanical strength of all the components involved, but also because the loss of amplitude, resulting in a gradual diminishing in size of the traced-out curves and patterns, is in fact the aesthetically most appealing aspect of the harmonograph according to the invention. Too small a loss of amplitude also means too dense a pattern, causing loss of resolution resulting in smudging. The ratio of the weight of the drawing surface 2 to the weight of the bob-like arrangement 12 of the second pendulum 10 is preferably a substantially whole, even number ratio, whereby the length of suspension is not critical and can be varied without loss of consistency of the generated pattern. Especially preferred ratios are tabulated below.

If the drawing surface 2 is made of a plastic material, hollow spaces may be provided, into which weights may be introduced, to bring the plastic drawing surface up to the desired weight or weights. Wooden drawing surfaces can be provided with a suitable set of weights, to be attached centrally at the bottom 16. Experiments can also be made with eccentrically mounted weights.

The main, cross-bracing and second-pendulum bob suspensions 6, 8 and 14, respectively, may be of any flexible, collapsible suspension means such as string, cord, wire, cable or thread of sufficient mechanical strength to support the respective masses attached. The main suspension cords 6 and the cross-bracing cords 8 may be distinct and separate pieces of cord attached by conventional means at selected preferably peripheral, points of the drawing surface 2 on the one hand, and on the member 4, on the other, or they may consist of two separate, closed loops, slung around the drawing surface 2 and the member 4 in such a way that each loop forms two main and two cross-bracing cords. In the latter case, the cords would be secured by slots provided at the selected points of suspension.

The distance between the points of suspension on the member 4 should be sufficiently large for the cross-bracing cords to strongly resist any rotational moment about the vertical axis, or at least cause it to damp out after no more than 3 to 5 oscillations. In a preferred embodiment with a drawing-surface size of 23×31 cm and a drawing-surface-to-member distance of 50 cm, this distance is 8 cm.

The actual tracing is performed by a stylus 18 attached to a counter-balanced holder 38 and movable in a vertical plane only. The stylus 18 can be any conventional ball-point pen, fiber-tip pen, drafting pen, pencil, crayon or the like. When a light-sensitive paper is used, the stylus can be a light pencil or other focused light source. The holder 38, adapted to swivel about a pivot 40 which is part of a bracket 42 firmly attached to the arm 20, has the shape of a bell-crank lever of unequal arms. The longer arm, carrying the stylus 18, includes with the shorter arm an obtuse angle and, when in a substantially horizontal position, with the stylus touching the drawing surface 2, has a turning moment about the pivot 40, which is larger than that of the short, slanted lever arm. The stylus 18 is thus in positive contact with the paper sheet taped to the drawing surface 2, and when the latter moves, will produce a line.

Contact pressure which should always be kept to the minimum required to induce the stylus 18 to write, can be adjusted by turning the counterweight screw 44. Turning the latter in the counterclockwise sense will increase the turning moment of the shorter lever arm, thereby counterbalancing some of the moment exerted by the stylus 18 and the longer lever arm and, thus, reduce contact pressure. Turning the screw 44 in the clockwise sense will have the opposite effect.

If the stylus 18 is lifted off the paper, the long lever arm, becoming less horizontal, loses moment, while the short lever arm, becoming more horizontal, gains moment. At a certain instant, the holder 38 will therefore flip over and, resting against a stop, stay put in its second position of rest, with the stylus 18 lifted clear off the drawing surface 2.

The second pendulum, the superposition of whose oscillations on the oscillations of the first pendulum constituted by the drawing surface 2 produces the desired geometrical patterns, consists of a bob-like arrangement 12 and a suspension cord 14 centrally attached to the bottom 16 of the drawing surface 2. As the geometrical patterns obtained are affected by the length and weight ratios of the two pendulums, the weight of the bob-like arrangement 12 and the length of the suspension cord 14 can be adjustable for increasing the variety of generatable patterns. To this end, the bob-like arrangement 12 is given the form of a hollow vessel which can be filled to the desired degree with any suitable weighting medium, such as water, sand, buckshot or the like. In another preferred embodiment, the bob-like arrangement consists of a base plate and central rod of known weight, which are hooked onto the suspension cord 14, and onto which are piled a number of slotted disks, each of known weight, to make up the total bob weight required.

The length of the suspension cord 14 is easily adjusted by conventional means, for example with the aid of a toggle arrangement similar to that used for the tightening of tent guy ropes.

As will be realized the harmonograph is operable in several ways including the following way: after the relative weights and lengths have been adjusted as desired and the stylus 18 has been lifted and flipped into its noncontact position, the two pendulums are manually displaced from their position of rest by pulling them simultaneously out of center, either in the same direction or in different or even opposite directions. The pendulums are then released, imparting to them at the same time a slight shove in the tangential direction, which will cause them to describe a curved orbit. After a few swings, when any rotational oscillations possibly caused by the initial impulse have died down, the stylus 18 is gently returned to its contact position and tracing begins.

Another way of initiating the tracing process is to pull out of center only the upper pendulum, that is, the drawing surface 2. Releasing the latter and sending it on its way by a gentle tangential push will also set the lower pendulum 10 oscillating.

Several different preferred distances, weights and weight ratios as related to groups of curves generated are tabulated in the following:

| Distance gimbal device - drawing surface cm | Distance drawing surface - C.G. lower pendulum cm | Weight of drawing surface gr | Weight of lower pendulum gr | Weight Ratio | Curves obtained FIG. 1 |
|---|---|---|---|---|---|
| 50 | 60 | 780 | 390 | 2:1 | 2–7 |
| 50 | 30 | 780 | 390 | 2:1 | 8–11 |
| 50 | 50 | 1500 | 187 | 8:1 | 12–14 |
| 50 | 50 | 500 | 1000 | 1:2 | 15 |
| 50 | 50 | 700 | 1050 | 2:3 | 16–20 |

As will be noted with reference to the attached figures, the aesthetically most pleasing harmonograms are generated when the weight ratio drawing surface/bob-like arrangement is approximately 2:1. While this is an especially preferred weight ratio, other ratios, too, can result in different aesthetically pleasing, consistent patterns, as shown.

Of especial significance is the discovery that, having established a specific weight ratio of, e.g., 2:1, the distance from the drawing surface to the center of gravity of the lower pendulum bob can be substantially varied, without disruption of the consistency of the generatable patterns, which fact enhances the utility of the harmonograph of the present invention for members of the general public of all ages.

It will be evident to those skilled in the art that the invention is not limited to the details of the foregoing illustrative embodiments and that the present invention may be embodied in other specific forms without departing from the essential attributes thereof, and it is therefore desired that the present embodiments be considered in all respects as illustrative and not restrictive, reference being made to the appended claims and all changes which come within the meaning and range of equivalency of the claims are therefore intended to be embraced therein.

What is claimed is:

1. A collapsible and compactable harmonograph adapted to generate compound harmonic oscillations and thereby record different, complex, consistent, geometrical patterns of diminishing scope, comprising (a) a drawing surface (b) means for freely suspending said drawing surface, said suspension means comprising gimbal means mounted above the drawing surface, a member secured to said gimbal means for conjoint movement therewith and a plurality of vertical and diagonal flexible collapsible suspension cords arranged in a selected manner connecting said member to the drawing surface to permit said drawing surface to undergo pendulum-like oscillations in an infinite number of vertical planes, but to be substantially restrained from performing rotational or torsional oscillations about its central vertical axis by virtue of said diagonal cords;

(c) a bob suspended by a flexible, collapsible suspension cord attached to the bottom side of said drawing surface, and (d) a stylus mountable independently of said drawing surface to contact said drawing surface at an adjustable contact pressure and to be held in positive contact therewith during the compound harmonic oscillation effected by the interaction of said two linked gravity pendulums.

2. A collapsible and compactable harmonograph according to claim 1, further comprising a mounting arm to the upper end of which is rigidly fixed the gimbal means from which said gimbal-mounted member is suspended and the other end of which is provided with means of attachment to a stationary support.

3. A collapsible and compactable harmonograph according to claim 2, wherein said stylus is pivotably attached to said mounting arm via a counterbalancing holder, to enable said stylus to assume two positions of rest, in contact with, or lifted away from, said drawing surface, and wherein said stylus is guided in such a way as to be movable only in a plane substantially perpendicular to said drawing surface.

4. A collapsible and compactable harmonograph according to claim 3, wherein said counterbalancing arm is in the shape of a bell-crank lever with two unequal arms including between them an obtuse angle, the longer arm clasping said stylus, the shorter arm being provided with a counterweight whose turning moment with respect to the lever fulcrum may be increased or reduced, thereby reducing or increasing the contact pressure of said stylus, and wherein, due to said obtuse angle between said lever arms, lifting the stylus-clasping arm beyond a certain point will cause the bell-crank lever to flip over in direction of the counterweight-bearing arm.

5. A collapsible and compactable harmonograph according to claim 1, wherein said gimbal means is provided with knife-edge elements.

6. A collapsible and compactable harmonograph according to claim 1, wherein said drawing surface is suspended from said gimbal-mounted member by at least four suspension cords and at least two pairs of opposed, crossed, diagonal cross-bracing cords.

7. A collapsible and compactable harmonograph according to claim 1, wherein the bob is of adjustable weight and length for variation of the generated harmonic patterns.

8. A collapsible and compactable harmonograph according to claim 1, wherein the weight ratio of said drawing surface to said bob is about 2:1.

* * * * *